US007017870B2

(12) United States Patent
Meyer

(10) Patent No.: US 7,017,870 B2
(45) **Date of Patent: *Mar. 28, 2006**

(54) MICROPHONE SUPPORT SYSTEM

(76) Inventor: Ronald L. Meyer, 5002 Copperhill Cir., Parker, TX (US) 75002

( * ) Notice: Subject to any disclaimer, the term of this patent is extended or adjusted under 35 U.S.C. 154(b) by 110 days.

This patent is subject to a terminal disclaimer.

(21) Appl. No.: 10/335,659

(22) Filed: Jan. 2, 2003

(65) Prior Publication Data

US 2003/0127572 A1 Jul. 10, 2003

Related U.S. Application Data

(60) Provisional application No. 60/346,590, filed on Jan. 7, 2002.

(51) Int. Cl.
*A47F 5/00* (2006.01)

(52) U.S. Cl. ..... 248/125.8; 156/91

(58) Field of Classification Search ..... 248/125.8, 248/638, 676, 121, 123.2, 146, 161; 138/118.1, 138/128; 156/201, 91; 381/363, 386, 368, 381/361, 366
See application file for complete search history.

(56) References Cited

U.S. PATENT DOCUMENTS

| | | | | |
|---|---|---|---|---|
| 3,653,625 | A | 4/1972 | Plice | |
| 3,924,083 | A | 12/1975 | Hagey | |
| 4,194,096 | A | 3/1980 | Ramsey | 179/147 |
| 4,396,807 | A | 8/1983 | Brewer | 179/146 |
| 4,449,020 | A | 5/1984 | Seebinger | 179/147 |
| 4,514,598 | A | 4/1985 | Plice | 179/146 |
| 4,546,950 | A | 10/1985 | Cech | 248/610 |
| 4,569,708 | A * | 2/1986 | Tanaka et al. | 156/91 |
| 4,955,578 | A | 9/1990 | Fidi | |
| 5,048,789 | A | 9/1991 | Eason | 248/544 |
| 5,154,381 | A | 10/1992 | Malinao | 248/178 |
| 5,340,066 | A | 8/1994 | Ditch | 248/170 |
| 5,435,871 | A * | 7/1995 | Streit | 156/201 |
| 5,490,599 | A | 2/1996 | Tohidi | 211/171 |
| 5,497,965 | A | 3/1996 | Mathieu | 248/159 |
| 5,713,553 | A | 2/1998 | Cooper | 248/461 |
| 5,863,015 | A | 1/1999 | Hsu | 248/157 |
| 5,893,541 | A | 4/1999 | Michaelson | 248/158 |
| 6,007,032 | A | 12/1999 | Kuo | 248/185.1 |
| 6,168,030 | B1 | 1/2001 | Morris | 211/13.1 |
| 6,316,706 | B1 | 11/2001 | Sammons | 84/327 |
| 6,459,802 | B1 | 10/2002 | Young | 381/368 |
| 6,487,298 | B1 * | 11/2002 | Hacker | 381/363 |

FOREIGN PATENT DOCUMENTS

| | | | |
|---|---|---|---|
| GB | 688730 | A | 3/1952 |
| JP | 2000-135875 | A * | 5/2003 |

* cited by examiner

*Primary Examiner*—Ramon O. Ramirez

(57) ABSTRACT

A microphone support system and a method of manufacturing therefor that substantially isolates a microphone from extraneous vibrations. In one embodiment, the microphone support system comprises a base assembly, a microphone support rod, a microphone sheath, a microphone cable, and a microphone cable sheath. The base assembly is configured to dampen at least some of the extraneous vibrations communicated to the support system. The microphone support rod is coupleable to the base assembly and is configured to support a microphone. The microphone sheath is coupled to the microphone support rod, substantially surrounds the microphone, and is configured to substantially isolate the microphone from at least some of the extraneous vibrations. Furthermore, the microphone cable is coupleable to the microphone, and the microphone cable sheath substantially surrounds the microphone cable and is configured to substantially isolate the microphone cable from at least some of the extraneous vibrations.

55 Claims, 7 Drawing Sheets

MICROPHONE SUPPORT SYSTEM

CROSS-REFERENCE TO PROVISIONAL APPLICATION

This Application claims priority from provisional application No. 60/346,590 entitled "Mechanical Vibration And Group Delay Effects on Recorded/Reproduced Audio Frequency Program Material," to Ronald L. Meyer, filed on Jan. 7, 2002, which is commonly assigned with the present invention and incorporated herein by reference as if reproduced herein in its entirety.

TECHNICAL FIELD OF THE INVENTION

The present invention is directed, in general, to a microphone holder and, more specifically, to a microphone support system that incorporates vibration shielding and damping to substantially isolate a microphone from extraneous vibrations.

BACKGROUND OF THE INVENTION

In modern music performance/recording, mechanical vibration effects on recorded/reproduced audio frequency program material are responsible for perceived (and measured) degradation of the natural transient response of all audio signals captured, stored, replayed, or reproduced by equipment of the prior art. It is a problem that exists at the system level, in all components of the system in one form or another.

The audio industry, since the inception of digital audio in the early 1980s, has faced criticism that digital recordings did not sound as good as their analog counterparts. Indeed, some fine quality recordings were produced by the technology of the late 1950's with analog recording and playback means. This was partially due to the prevalent design techniques used for microphones and microphone stands, along with the materials used in the wiring, and the design of enclosures and chassis. It was also partially due to a more direct signal recording and playback equipment path. That is, there were fewer pieces of equipment to contribute bad effects to the program material, and extra "processing" was not thought of as necessary. Additionally, since the effects of vibration, in some respects, are more detrimental to digital recording and reproduction than to analog processing, the analog recording/playback systems sounded better. In fact, they did indeed capture a better transient response in program material than did the newer digital recordings for reasons disclosed herein.

Microphones are the most susceptible link in the reproduction chain due to their proximity to the original sound source and their natural susceptibility to vibrations. They are self-evidently and inherently, the most sensitive component due to their function, which is to convert airborne vibrations sensed by the element(s) into low level electrical signals for further amplification, storage, analysis, or later reproduction. However, microphone designers have not successfully understood the issue of microphone enclosure vibrations that are also received from the environment, and how they translate into extra modulations which add to the sound already received and are converted by the main microphone sensing element(s). These enclosure-borne vibrations seriously degrade the signal received by the microphone sensing element(s). More specifically, it has been determined that the resonances of various materials comprising the microphone mounting mechanism(s) and stand assembly can cause smeared signal transients.

Common sources of vibration (unwanted inputs to the system) include the program material of interest, "monitoring" equipment used to listen to the desired program material during the recording/reproduction process, internal vibrations generated by power transformers or the mechanisms used to manipulate media (CD or tape transports) used to record or process the desired program material. Even air pressure changes caused by low frequency air handler equipment for HVAC systems (Heating, Ventilation, and Air-Conditioning) can cause vibrations to be introduced into the recorded/amplified program.

The degradation comes in multiple forms, depending on: (a) the type of equipment (analog or digital based signal processing), (b) location in the recording/reproduction chain (microphone or front end processing vs compact disc player playback and power amplifier combination back end processing), and (c) the relative magnitude of the vibration in relation to the signal processing being performed at that stage in the chain. Common effects of the various vibration sources include, but are not necessarily limited to: (a) data clock perturbations in digital systems as a byproduct of the reference crystal vibration (jitter, drift, modulation based on program material), (b) microphonic transfer of vibration to power supply lines which then subsequently modulate the desired program material as a product of amplification, and (c) microphonic transfer of vibration to the microphone electronics through the microphone stand/holder assembly and microphone wiring which then subsequently modulates the desired program material as a by-product of sensing and amplification.

Referring initially to FIG. 1, illustrated is a conventional microphone stand 100 holding a conventional microphone 110. The conventional microphone stand 100 comprises a base 120, a first vertical support pole 121, a second vertical support pole 122, an adjustable support pole 123, a first support pole clutch assembly 124, a second support pole clutch assembly 125, a pole-to-microphone adapter 130, a microphone holder 140, and cable clamps 150. The microphone stand 100 stands upon a floor 101 and supports the microphone 110. The microphone 110 has a microphone body 111 coupled to a microphone cable 160. The microphone cable 160 is coupled to the first vertical support pole 121, the second vertical support pole 122, and the adjustable support pole 123 with the cable clamps 150. In the embodiment shown, the base 120, the first vertical support pole 121, second vertical support pole 122, adjustable support pole 123, first support pole clutch assembly 124, second support pole clutch assembly 125, pole-to-microphone adapter 130, microphone holder 140, and cable clamps 150 typically comprise resonant materials such as metal, hard plastic, etc. In one embodiment, the base 120 may have rubber feet 126 to decouple vibration arising from the floor 101.

The major effect of the various vibration sources is the microphonic transfer of vibration to the microphone electronics through the microphone stand/holder assembly and microphone wiring. The vibrations subsequently modulate the desired program material as a by-product of sensing and amplification. In most cases little special care has been taken to isolate the microphone sensing element(s) (not shown) from the microphone body 111. In an embodiment considered to be among the best of the prior art, the microphone holder 140 comprises some form of elastic suspension bands 141 coupled between a circumferential ring 142 and the microphone 110. Various forms of this general method of isolation are disclosed in U.S. Pat. No. 6,459,802 to Young, U.S. Pat. No. 4,546,950 to Cech, U.S. Pat. No. 4,396,807 to Brewer, U.S. Pat. No. 4,194,096 to Ramsey, ostensibly to isolate the microphone 110 from floor-borne, low frequency vibrations. The above listed patents are hereby incorporated by reference. While it is desirable to isolate the microphone/stand combination from floor-borne vibrations, the methods of the prior art subject the microphone elements to significantly larger degradations from airborne vibrations through the microphone enclosure (the microphone body 111 or case) which is generally not protected in any way from airborne vibrations. Extraneous vibrations can be additionally magnified when the microphone (sensor) is suspended via these weblike mechanisms, as in the listed prior art, in an effort to isolate it from the low frequency vibrations transmitted from the floor. This is accomplished at the expense of exposure to the significantly higher levels and wider frequency spectrum of vibration levels available directly through the air. These vibrations must also be addressed in the quest to control the recording/reproduction process in an effort to preserve the transient response of the desired signal to be recorded or processed. With the prior art, the conventional microphone 110 receives, and inadvertently converts to an electrical signal, those vibrations it receives through the microphone body 111 and the microphone cable 160, along with the airborne vibrations sensed by the microphone element from the desired signal. Vibrations in the microphone stand/holder assembly also can cause very small movements of the entire microphone 110, and therefore the element(s) of the microphone while it is receiving the desired signal. Vibrations of the microphone stand 100 also cause a lever arm effect on the suspended microphone 110 which magnifies the effect of small vibrations in the microphone stand 100.

In most cases little special care has been taken to isolate the microphone sensing element(s) from the microphone body. Generally, the microphone itself is, in the presumed best form of the prior art, suspended in air via elastic webs, ostensibly to isolate it from floor-borne low frequency vibrations. While it is desirable to isolate the microphone/stand combination from floor-borne vibrations, the method of the prior art subjects the microphone assembly to significantly larger degradations from airborne vibrations through its enclosure (the microphone body or case) which is not protected in any way from extraneous airborne vibrations. Ideally, the best mounting mechanism would reveal the main (desired) sensing element(s) to the sounds to be converted into electrical signals, while keeping the body of the microphone, and therefore the remaining electronics inside it, isolated from extraneous airborne vibrations. With the prior art, the microphone receives and inadvertently converts vibrations it receives through its case and the microphone wire, along with the vibrations sensed by the main (desired) element from the desired signal. Consequently, any vibrations, including extraneous solid-body vibrations, received through the microphone body ill or its holding mechanism 140, stand 100, and cabling 160 get combined with the desirable sounds from an intended source impinging on the main microphone element (s); thereby the net combination of these signals becomes the overall signal produced by the microphone 110, microphone holding system 100, and cabling 160.

Accordingly, what is needed in the art is a microphone support system that does not suffer from the transmission of extraneous vibrations to the sensing element(s) of the microphone.

SUMMARY OF THE INVENTION

To address the above-discussed deficiencies of the prior art, the present invention provides a microphone support system that substantially isolates a microphone from extraneous vibrations comprising a base assembly, a microphone support rod, a microphone sheath, a microphone cable, and a microphone cable sheath. In a preferred embodiment, the base assembly is configured to dampen at least some of the extraneous vibrations communicated to the support system. The microphone support rod is coupleable to the base assembly and is configured to support a microphone. The microphone sheath substantially surrounds the microphone and is coupled to the microphone support rod wherein the microphone sheath is configured to substantially isolate the microphone from at least some of the extraneous vibrations. Furthermore, in the preferred embodiment, the microphone cable is coupleable to the microphone, and the microphone cable sheath substantially surrounds the microphone cable and is configured to substantially isolate the microphone cable from at least some of the extraneous vibrations.

In another embodiment, the present invention provides a method of manufacturing a microphone support system that substantially isolates a microphone from extraneous vibrations. The method includes: (1) providing a base assembly configured to dampen at least some of the extraneous vibrations communicated to the support system, (2) coupling a microphone support rod to the base assembly and configuring the microphone support rod to support a microphone, (3) coupling a microphone sheath to the microphone support rod and substantially surrounding the microphone, the microphone sheath configured to substantially isolate the microphone from at least some of the extraneous vibrations, (4) coupling a microphone cable to the microphone, and (5) coupling a microphone cable sheath to and substantially surrounding the microphone cable, the microphone cable sheath configured to substantially isolate the microphone cable from at least some of the extraneous vibrations.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
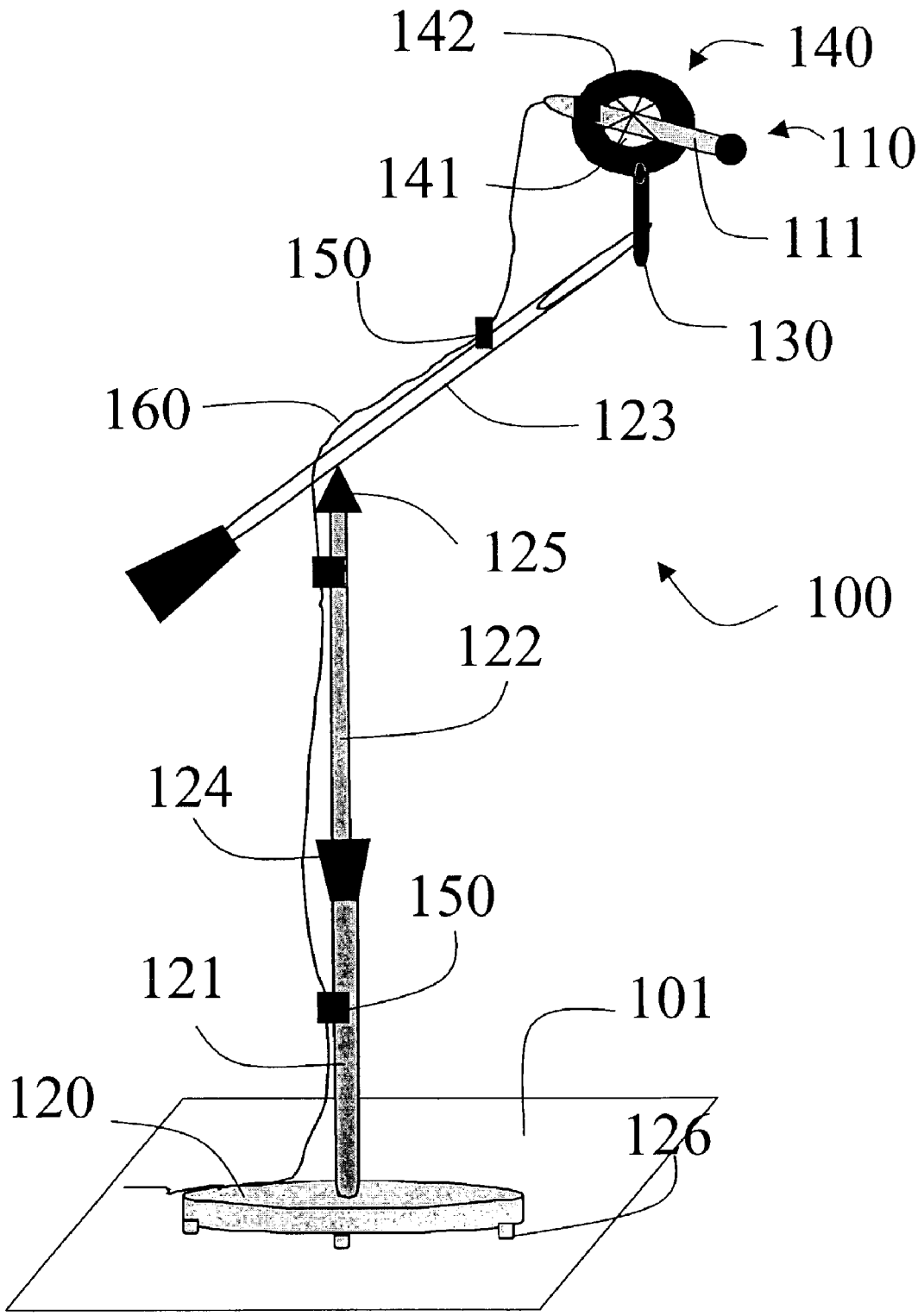
FIG. 1 Prior Art
FIG. 1 illustrates a conventional microphone stand holding a conventional microphone.
Figure 2:
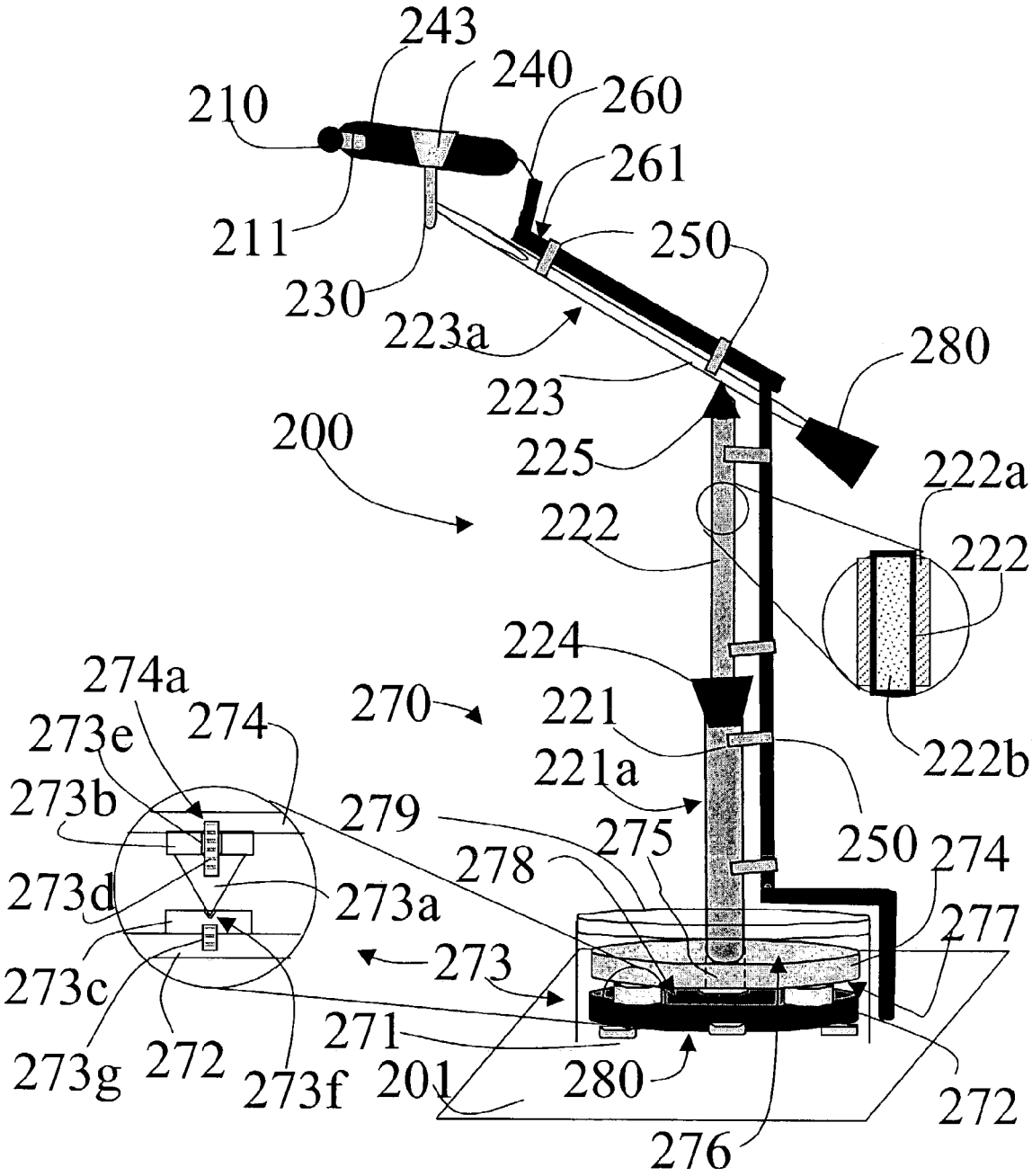
FIG. 2 illustrates one embodiment of a microphone support system constructed according to the principles of the present invention.

Referring now to FIG. 2, illustrated is one embodiment of a microphone support system, generally designated 200, constructed according to the principles of the present invention. In the illustrated embodiment, the microphone support system 200 comprises a first vertical support pole 221, a second vertical support pole 222, an adjustable support pole 223, a first support pole vibration-conducting coupling 224, a second support pole vibration-conducting coupling 225, a pole-to-microphone adapter 230, a microphone holder 240, a microphone sheath 243, cable clamps 250, a base assembly 270, and a counterweight 280. The microphone support system 200 supports a conventional microphone 210 that has a microphone body 211. The microphone body 211 is electrically and mechanically coupled to a microphone cable 260. In a preferred embodiment, the microphone cable 260 is substantially surrounded about its entire length with a vibration-absorbing coating 261 that substantially isolates the microphone 210 from at least some of any vibration that might impinge on the microphone cable 260. In one embodiment, only those areas of the microphone cable 260 very close to the microphone body 211, and to the recording/reproduction electronics (not shown) are not covered with the vibration-absorbing coating/sheath 261. In a preferred embodiment, the vibration-absorbing coating/sheath 261 is polystyrene foam. The microphone cable 260 is mechanically coupled to the first vertical support pole 221, the second vertical support pole 222, and the adjustable support pole 223 with the cable clamps 250. In the illustrated embodiment, the microphone support system 200 is designed to be placed on a support element 201 that may be subjected to extraneous vibrations. In the embodiment shown, the support element 201 is a conventional floor, presumably of a musical performance/recording studio, although the microphone support system 200 may be used at other locations, e.g. a stage, meeting room, etc. In another embodiment, the support element may be a desk (not shown) or any surface suitably strong enough to support the microphone support system 200. In such a desk-mounted system, as one who is skilled in the art will readily understand, the size and number of the support poles may be significantly reduced while the general principles of the present invention are applied. The extraneous vibrations may be caused by any of the previously listed sources including, but not limited to: a live music source, e.g., musical instruments, and the heating ventilation and air conditioning system (HVAC), etc.

Details of two embodiments of the microphone holder will be addressed below with reference to FIGS. 3A and 3B. For the sake of the present discussion, it is sufficient to note that the conventional microphone 210 is substantially surrounded by vibration-absorbing or vibration-resistant material (microphone sheath 243) in accordance with the principles of the present invention.

In one embodiment, the base assembly 270 comprises vibration-isolating feet 271, a vibration-resistant sub-base 272, vibration-absorbing receptacles 273, a non-resonant base 274, and a base assembly cover 279. In a preferred embodiment, the non-resonant base 274 comprises a circular base made of carbon fiber material such as is produced by Black Diamond Racing, Inc. (BDR), a division of D. J. Casser Enterprises, Inc., Milwaukee, Wis. In one embodiment, the diameter of the non-resonant base 274 may be between about 16" and 18". In a preferred embodiment, the non-resonant base 274 may have a threaded hole 275 for coupling to the first vertical support pole 221. In another embodiment, an upper surface 276 of the non-resonant base 274 may have a threaded flange (not shown) coupled to it for coupling to the first vertical support pole 221. One who is skilled in the art is familiar with the use of threaded flanges for coupling threaded poles to flat surfaces. Performance of the recording/reproduction system was noticeably better with the threaded hole 275 embodiment.

In one embodiment, the vibration-absorbing receptacles 273 may comprise carbon fiber "cones" 273*a*, "pucks" 273*b*, and "pits" 273*c*. The cones 273*a*, pucks 273*b* and pits 273*c* may be ones available from BDR. The cones 273*a* comprise solid carbon fiber formed as a cone with an imbedded threaded rod 273*d*. In a preferred embodiment, the non-resonant base 274 may have a plurality of threaded holes 274*a* in a lower surface 277 thereof to which the cones 273*a* and pucks 273*b* may be coupled in a point-down configuration. The pucks 273*b* also comprise carbon fiber similar in appearance to a hockey puck with a central hole 273*e*. The pits 273*c* are coupled to an upper surface 278 of the sub-base 272 and have a depression 273*f* on one surface that receives the point of a cone 273*a*. In the illustrated embodiment, the pits 273*c* may include an imbedded threaded rod 273*g* used to coupled the pits 273*c* to the upper surface 278 of the sub-base 272. In a preferred embodiment, at least three pairs of pucks 273*b*, cones 273*a*, and pits 273*c* are employed.

In a preferred embodiment, the vibration-resistant sub-base 272 comprises a circular oak plywood disk of a similar size to the non-resonant base 274. In one embodiment, the sub-base 272 is 1.25 inch thick, circular oak plywood that is a substantially non-resonant material. In one embodiment, the sub-base 272 may additionally be coated with an additional, non-resonant material, such as a fiberglass-reinforced epoxy resin, to further reduce susceptibility to vibration. A suitable fiberglass-reinforced polyester/epoxy resin is Evercoat®, a product of the Fibre Glass-Evercoat Company of Cincinnati, Ohio. In one embodiment, an upper surface 278 of the sub-base 272 may have threaded holes (not shown) configured to accept mounting bolts for BDR "Thick Pits." The Thick Pits have deep dimples 273*f* on their exposed surface to receive points of the cones 273*a*. The vibration-resistant sub-base 272 absorbs, through the vibration-absorbing receptacles 273, at least some of the vibration that may impinge upon the entire microphone support system 200.

In a preferred embodiment, the sub-base 272 has vibration-isolating feet 271 coupled to an undersurface 280 of the sub-base 272. The vibration-isolating feet 271 serve to substantially isolate the vibration-resistant sub-base 272 from at least some of the floor-borne vibrations. In a preferred embodiment, the vibration-isolating feet 271 may comprise rubber bushings. In another embodiment, the rubber bushings may be a type 6 (ribbed bushing) or type 7 (ribbed ring) commonly available from the McMaster-Carr Company of Atlanta, Ga.

The base assembly 270 may further comprise a base assembly cover 279 substantially surrounding the sub-base 272, the vibration-isolating feet 271 and the non-resonant base 274. The base assembly cover 279 couples to the base assembly 270 by surrounding the first vertical support pole 221 and substantially shields the base assembly 270 from at least some of any extraneous vibrations, including airborne vibrations. The vibration-isolating feet 271 substantially isolate the sub-base 272 from floor-borne vibrations.

The base assembly 270 is coupled to the first vertical support pole 221 as detailed above with or without a flange. In turn, the first vertical support pole 221 is coupled to the second vertical support pole 222 with the first support pole vibration-conducting coupling 224. The second vertical support pole 222 is coupled to the adjustable support pole 223 with the second support pole vibration-conducting coupling 225. In a preferred embodiment, the first and second support pole vibration-conducting couplings 224, 225 are constructed of substantially non-resonant material such as a brass collet and a brass jamb nut. However, these first and second support pole vibration-conducting couplings 224, 225 are vibration conducting, and will serve to conduct any vibrations impinging upon the microphone body 211 down into the base assembly 270.

Additionally, the first vertical support pole 221, second vertical support pole 222 and the adjustable support pole 223 may be surrounded or coated with a vibration-damping coating 221*a*, 222*a*, 223*a*. The vibration-damping coating may be a flexible rubber. Suitable flexible rubber coatings are also available from McMaster-Carr. In another embodiment, the vibration-damping coating may be polystyrene foam. In yet another embodiment, the vibration-damping coating may be polyethylene foam. In still yet another embodiment, the vibration-damping coating may be elastomeric foam. In a similar manner, the first support pole vibration-conducting coupling 224 and the second support pole vibration-conducting coupling 225 may be constructed of brass, which is substantially non-resonant. In this embodiment, the second vertical support pole 222 and the adjustable support pole 223 may be advantageously hollow and therefore filled with a vibration-damping filler 222*b* to effectively dampen the normal resonant modes of the support poles 222, 223 while allowing high frequency vibrations to be transmitted to the absorbing base assembly 270. In one embodiment, the vibration-damping filler 222*b* comprises lead and sand. In a preferred embodiment, the vibration-damping filler 222*b* is a 50/50 mixture by volume of #7 or #8 lead shot and play sand.

Figure 3A:
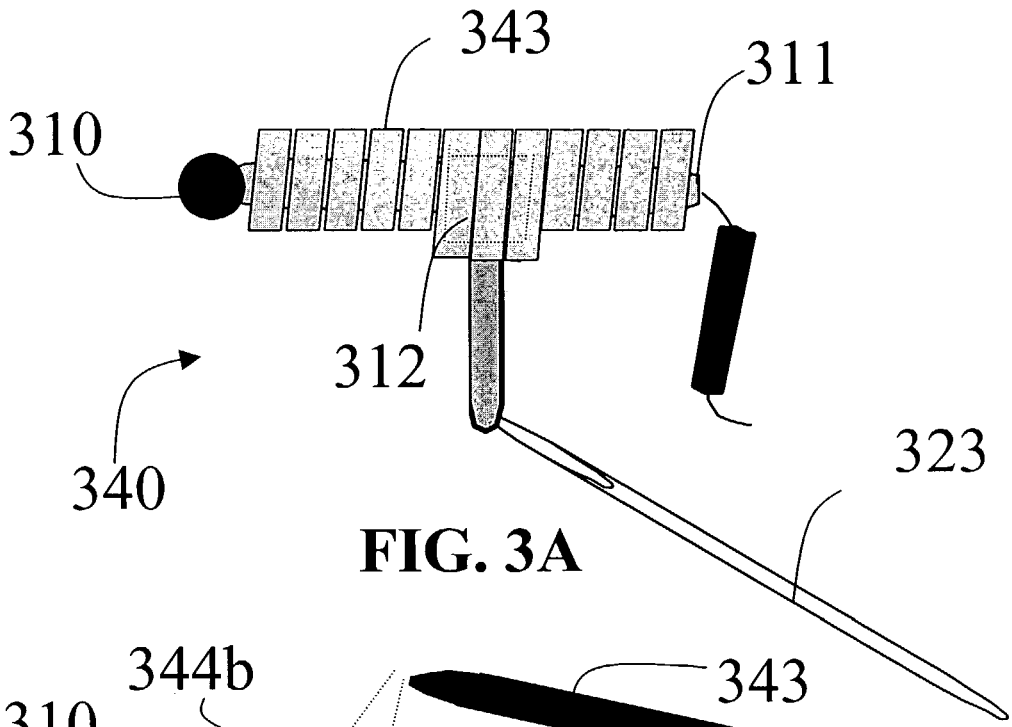
FIG. 3A illustrates one embodiment of a microphone holder constructed according to the principles of the present invention.

Referring now to FIG. 3A with continuing reference to FIG. 2, illustrated is one embodiment of a microphone holder, generally designated 340, constructed according to the principles of the present invention. In the illustrated embodiment, a conventional microphone 310 has a microphone body 311 and a hard mount 312 for coupling to a conventional microphone stand 323. The hard mount 312 also provides for the vibration coupling of the microphone body 311 to the microphone stand 200 of FIG. 2. In this embodiment, the microphone holder 340 comprises a microphone sheath 343 of vibration-absorbing material substantially isolating the microphone 310 from at least some of any extraneous vibration. In one embodiment, the vibration-absorbing material is foam rubber. In another embodiment, the vibration-absorbing material is a polymer resin. In a perferred embodiment, the vibration-absorbing material is Rubatex insulation tape. Rubatex insulation tape is a closed cell, polymer foam insulation tape manufactured by RBX Industries, Inc., of Roanoke, Va. The insulation tape may be wrapped and shaped to ensure minimal impact on the reception pattern of the microphone 310 as well as thorough coverage of the exposed microphone body 311. The use of vibration-absorbing material allows the sheath 343 to absorb extraneous vibrations, such as airborne vibrations, prior to the vibration's impact on the microphone body 311. The result is that the microphone 310 is shielded from extraneous vibration, and whatever vibration the microphone body 311 does receive is channeled downward through the stand 200 into the base assembly 270 where absorbing material dissipates the vibration.

Figure 3B:
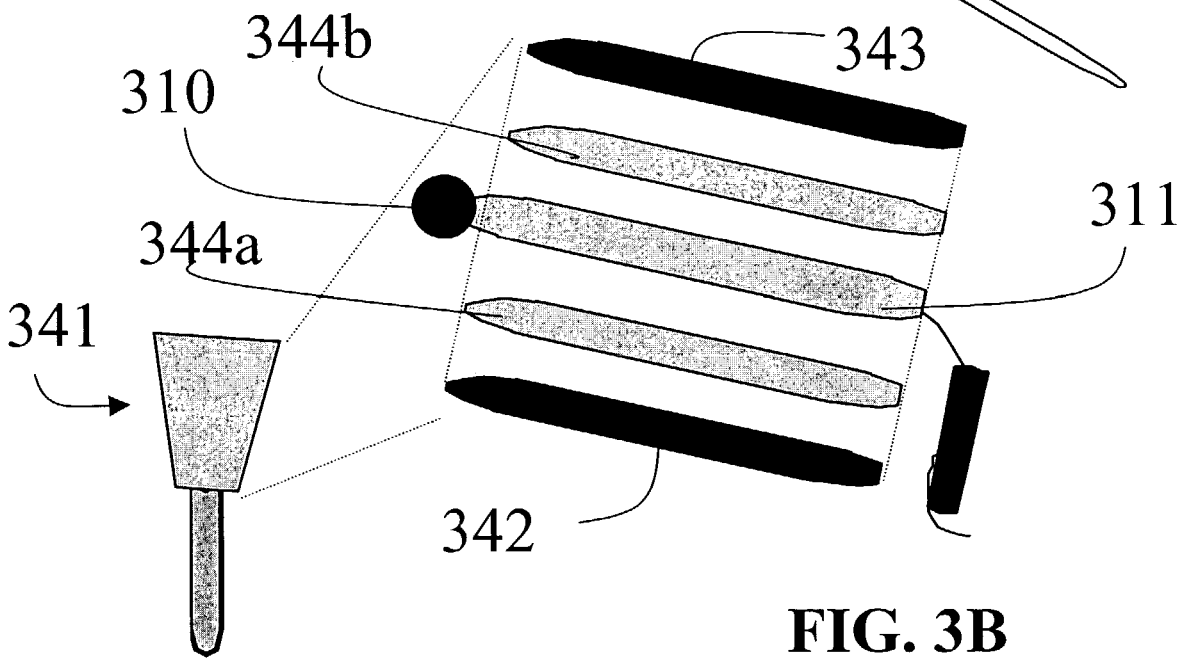
FIG. 3B illustrates an alternative embodiment of a microphone holder constructed according to the principles of the present invention.

Referring now to FIG. 3B, illustrated is an alternative embodiment of a microphone holder 341 constructed according to the principles of the present invention. In the illustrated embodiment, the conventional microphone 310 has a microphone body 311 but does not have a hard mount for coupling to a conventional microphone stand, thereby requiring a different approach. A microphone 310 of this type typically uses a holder shaped like a circle, or semicircle, into which the microphone 310 is slid, or a clamp of some sort to grab the microphone body 311 in order to hold the microphone 310. In this embodiment, the microphone holder 341 comprises a two-part outer shell 342, 343, and an inner packing 344 shown as two parts 344*a*, 344*b*. In one embodiment, the two-part outer shell 342, 343 comprises a section of PVC pipe shorter than the length of the microphone 310 and cut lengthwise to create two halves 342, 343. The two halves 342, 343 have rounded/sculpted ends to minimize the shielding effect on the desired reception pattern of the basic microphone 310. In a preferred embodiment, the inner packing 344 comprises a lining of the two halves 342, 343 with Evercoat. The Evercoat lining comprises a densely packed fiberglass material which allows a good vibration-resistive coupling to the microphone body 311 while enabling a channeling of vibration received by the PVC halves 342, 343 down into the microphone stand. This effectively isolates the microphone 310 from both airborne and floor-borne vibrations. It should be understood that the alternative microphone holder embodiments of FIGS. 3A and 3B may be employed with any of the microphone stand embodiments of FIG. 2, 4, 5 or 6.

Figure 4:
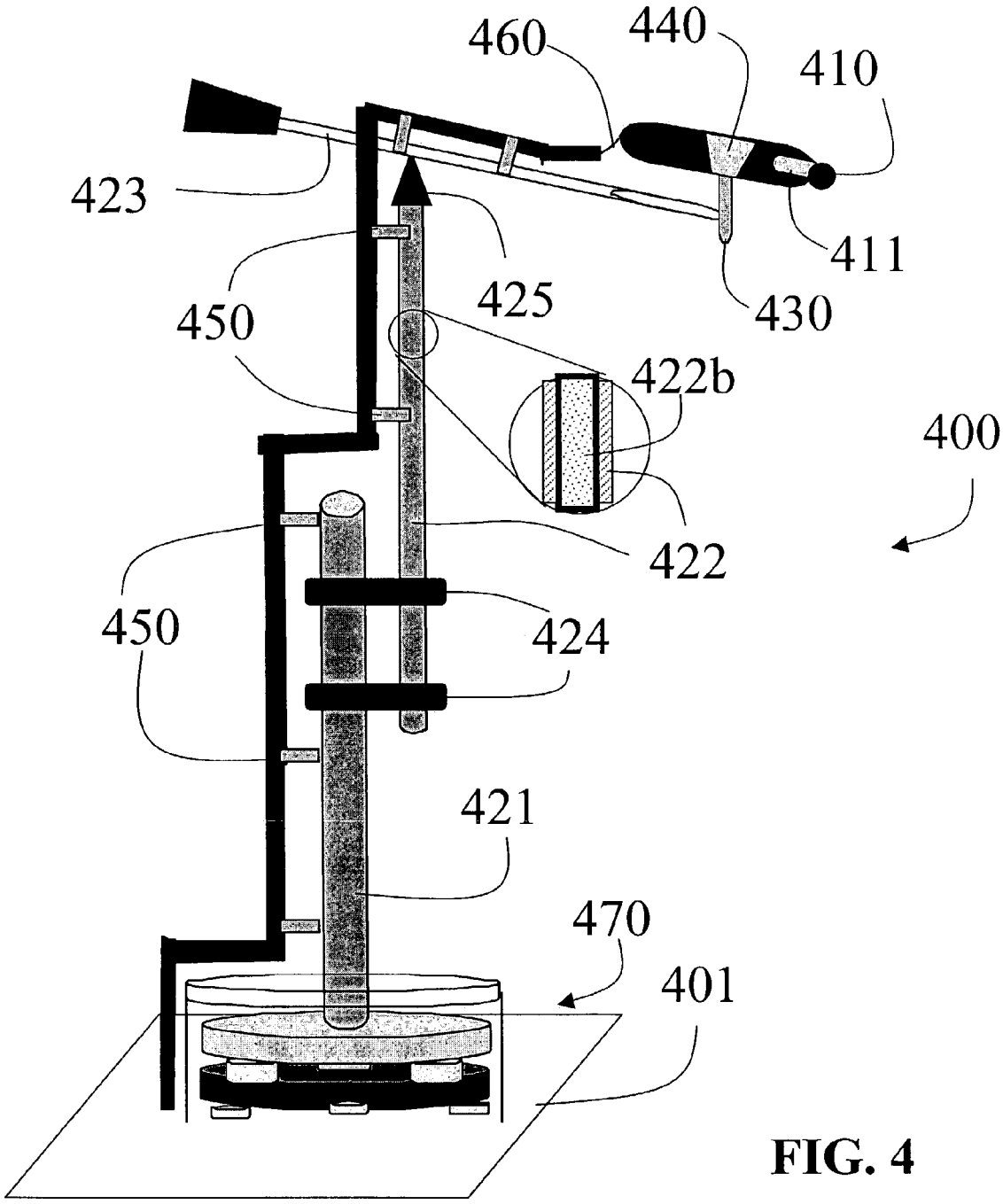
FIG. 4 illustrates an alternative embodiment of a microphone support system employing non-concentric vertical poles constructed according to the principles of the present invention.

Referring now to FIG. 4, illustrated is an alternative embodiment of a microphone support system, generally designated 400, employing non-concentric vertical poles constructed according to the principles of the present invention. In the illustrated embodiment, the microphone support system 400 comprises a first vertical support pole 421, a second vertical support pole 422, an adjustable support pole 423, a first support pole vibration-conducting coupling 424, a second support pole vibration-conducting coupling 425, a pole-to-microphone adapter 430, a microphone holder 440, cable clamps 450, and a base assembly 470. The microphone support system 400 supports a conventional microphone 410 that has a microphone body 411 that is coupled to a microphone cable 460. The microphone cable 460 is coupled to the first vertical support pole 421, the second vertical support pole 422, and the adjustable support pole 423 with the cable clamps 450. In the illustrated embodiment, the microphone support system 400 is designed to be supported on a support element 401 that may be subjected to a mechanical vibration. Of course, one who is skilled in the art will recognize that the microphone support system may also be subjected to other extraneous vibrations, such as airborne vibrations, as detailed above.

The illustrated embodiment of FIG. 4 demonstrates an alternative embodiment of the present invention constructed with non-concentric vertical support poles 421, 422. Such a configuration takes advantage of further damping material within the support poles 421, 422. In this embodiment, the first and second vertical support poles 421, 422 are advantageously hollow and are filled with a vibration-damping filler 422*b* to effectively dampen the normal resonant modes of the support poles 421, 422 while allowing high frequency vibrations to be transmitted to the absorbing base assembly 470. In a preferred embodiment, the base assembly 470 is analogous in materials and construction to the base assembly 270 of FIG. 2. In one embodiment, the first and second vertical support poles 421, 422 comprise steel. In one embodiment, the vibration-damping filler 422*b* is a mixture of lead shot and sand. In a preferred embodiment, the vibration-damping filler 422*b* is a 50/50 mixture by volume of #7 or #8 lead shot and play sand.

Figure 5:
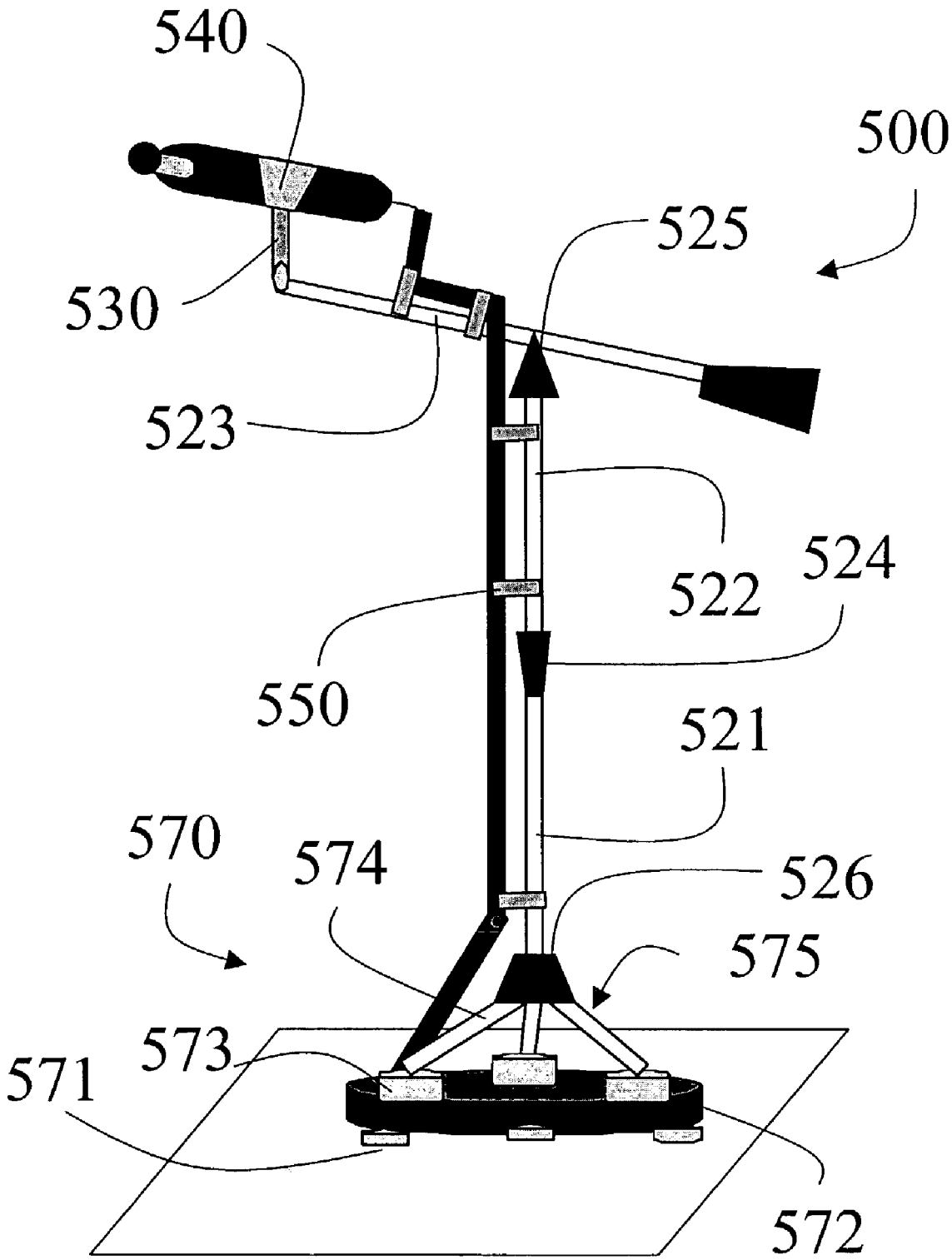
FIG. 5 illustrates an alternative embodiment of a microphone support system of FIG. 2 employing a tripod style of a base assembly constructed according to the principles of the present invention.

Referring now to FIG. 5, illustrated is an alternative embodiment of a microphone support system of FIG. 2, generally designated 500, employing a tripod style of a base assembly constructed according to the principles of the present invention. In the illustrated embodiment, the microphone support system 500 comprises a first vertical support pole 521, a second vertical support pole 522, an adjustable support pole 523, a first support pole vibration-conducting coupling 524, a second support pole vibration-conducting coupling 525, a base-to-pole vibration-conducting coupling 526, a pole-to-microphone adapter 530, a microphone holder 540, cable clamps 550, and a base assembly 570. All components above the base-to-pole vibration-conducting coupling 526 are analogous to and therefore may be identical to the associated components of the microphone support system 200 of FIG. 2.

In the illustrated embodiment of FIG. 5, the base assembly 570 employs a tripod style of base assembly. In one embodiment, the base assembly 570 comprises vibration-isolating feet 571, a vibration-resistant sub-base 572, vibration-absorbing receptacles 573, and a plurality of non-resonant legs 574. In one embodiment the microphone support system 500 may also comprise a base cover (not shown). In a preferred embodiment, the plurality of non-resonant legs 574 comprises hollow steel poles with a vibration-damping coating 575 or a vibration-damping filling as in the support poles 421, 422 of FIG. 4. In one embodiment, the base-to-pole vibration-conducting coupling 526 comprises non-resonant materials such as a brass/PVC combination and may additionally comprise a vibration-damping coating 575. The vibration-isolating feet 571, vibration-resistant sub-base 572, and vibration-absorbing receptacles 573 are analogous and may be identical to the associated components of the microphone support system 200 of FIG. 2. In one embodiment, the vibration-absorbing receptacles 573 may be pits similar to the pits 273*c* of FIG. 2. In another embodiment, the sub-base 572 may additionally be coated with a non-resonant material, such as Evercoat, the fiberglass-reinforced epoxy resin detailed above, to further reduce susceptibility to vibration.

Figure 6:
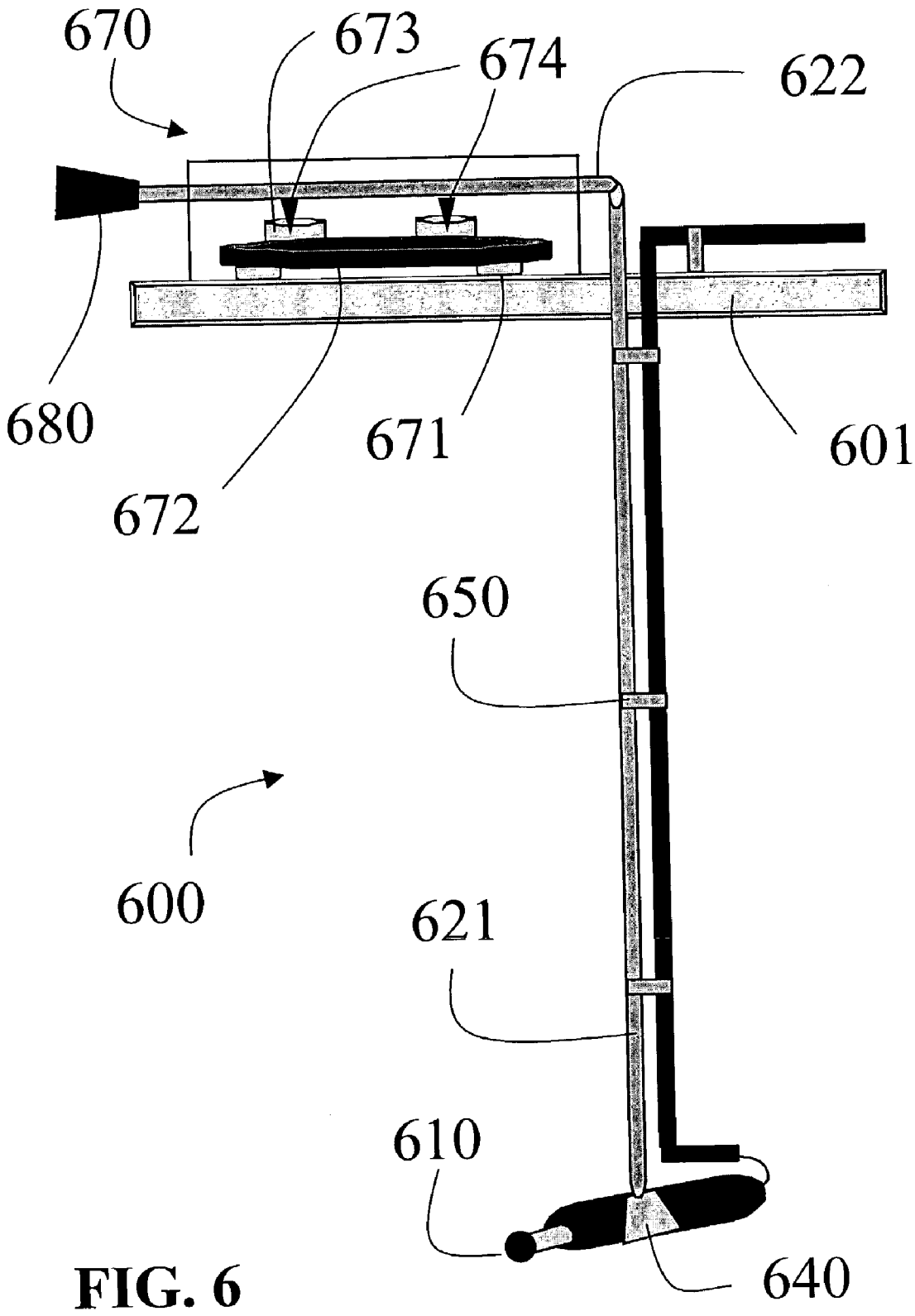
FIG. 6 illustrates an alternative embodiment of a microphone support system employing a ceiling-suspension system that is similar in many respects to the microphone support system of FIG. 2 and constructed according to the principles of the present invention.

Referring now to FIG. 6, illustrated is an alternative embodiment of a microphone support system, generally designated 600, employing a ceiling-suspension system that is similar in many respects to the microphone support system 200 of FIG. 2 and constructed according to the principles of the present invention. The microphone support system 600 holds a conventional microphone 610. In the illustrated embodiment, the microphone support system 600 comprises a vertical support pole 621, a horizontal support pole 622, a microphone holder 640, cable clamps 650, a base assembly 670, and a counterweight 680. The microphone support system 600 is suspendable from a ceiling beam(s) 601.

In a preferred embodiment, the base assembly 670 comprises vibration-isolating feet 671, a vibration-resistant sub-base 672, and vibration-absorbing receptacles 673. In the illustrated embodiment, the base assembly 760 also includes support cones 674 that are coupled to the horizontal support pole 622 and are configured to rest upon the vibration-absorbing receptacles 673. All components below and including the vertical support pole 621 are analogous to and may be identical to similar components of the microphone support system 200 of FIG. 2.

Figure 7:
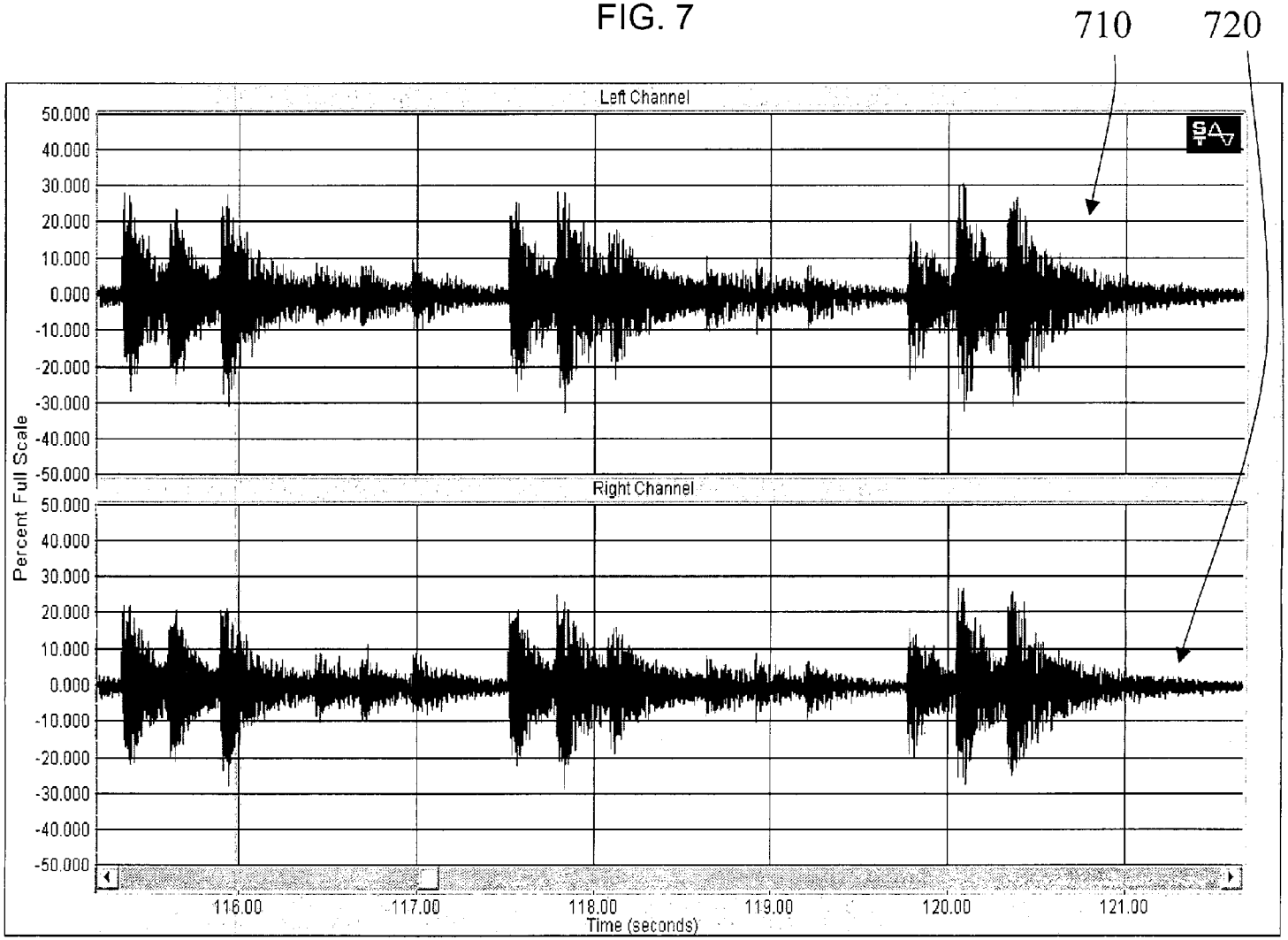
FIG. 7 illustrates comparative graphs of system response to a sound as recorded by a conventional microphone on a conventional stand and the same sound as recorded by a conventional microphone on a stand constructed according to the principles of the present invention.

Referring now to FIG. 7, illustrated are comparative graphs of system response to a sound as recorded by a conventional microphone on a conventional stand and the same sound simultaneously recorded by a substantially-identical, (both microphones have matched performance graphs) conventional microphone on a stand constructed according to the principles of the present invention. The upper chart 710 (left channel) illustrates the response of a conventional microphone shielded and mounted on a microphone support system of the present invention as described above. The lower chart 720 (right channel) illustrates the response of a conventional microphone mounted on a conventional microphone stand to the same sound. As can be seen, the amplitude (percent of full scale) response of the left channel (present invention) is approximately 10 percent higher throughout than the response of the right channel (conventional system). The difference between the two systems (what could be characterized as the left channel signal minus the right channel signal) illustrates the corruption in the desired signal caused by vibration-induced effects on the microphone sensing element(s) and the amplification electronics.

Thus, an improved microphone support system with vibration damping material applied to, or used in construction of, each component of the microphone support system has been described. The effect is to substantially inhibit the effects of unwanted extraneous vibrations that would otherwise impinge upon the microphone and its body, thereby causing undesirable alteration of the signal to be recorded or reproduced by the system electronics.

While the preferred embodiment as described includes a number of enhancements associated with each of the above listed elements of the microphone support system, one who is skilled in the art will recognize that at least some improvement in a recorded/reproduced audio signal may be realized by some smaller set of individual enhancements to the listed elements.

Although the present invention has been described in detail, those skilled in the art should understand that they can make various changes, substitutions and alterations herein without departing from the spirit and scope of the invention in its broadest form.

What is claimed is:

1. A microphone support system that substantially isolates a microphone from extraneous vibrations, comprising:

a base assembly configured to dampen at least some of said extraneous vibrations communicated to said support system;

a hollow microphone support rod, coupleable to said base assembly, substantially filled with a vibration-damping filling and configured to support said microphone;

a microphone sheath substantially surrounding said microphone and coupled to said hollow microphone support rod, said microphone sheath configured to substantially isolate said microphone from at least some of said extraneous vibrations;

a microphone cable coupleable to said microphone; and a microphone cable sheath substantially surrounding said microphone cable and configured to substantially isolate said microphone cable from at least some of said extraneous vibrations.

2. The microphone support system as recited in claim 1 wherein said hollow microphone support rod comprises a vibration-damping coating.

3. The microphone support system as recited in claim 2 wherein said vibration-damping coating comprises a rubber coating or polystyrene foam coating.

4. The microphone support system as recited in claim 1 further comprising an adjustable support pole coupleable to said hollow microphone support rod and configured to support said microphone.

5. The microphone support system as recited in claim 1 wherein said vibration-damping filling comprises sand and lead shot.

6. The microphone support system as recited in claim 1 wherein said base assembly is a free-standing base assembly or a ceiling-suspended base assembly.

7. The microphone support system as recited in claim 1 wherein said base assembly comprises:

a vibration-resistant sub-base having an upper surface and an undersurface;

vibration-isolating feet coupled to said undersurface; and vibration-absorbing receptacles coupled to said upper surface.

8. The microphone support system as recited in claim 7 wherein said vibration-resistant sub-base comprises a substantially non-resonant material coated with fiberglass-reinforced epoxy resin.

9. The microphone support system as recited in claim 7 wherein said vibration-isolating feet comprise rubber bushings.

10. The microphone support system as recited in claim 7 wherein said vibration-absorbing receptacles comprise carbon fiber pits.

11. The microphone support system as recited in claim 7 wherein said base assembly further comprises a non-resonant base coupleable to said hollow microphone support rod.

12. The microphone support system as recited in claim 7 wherein said base assembly further comprises a plurality of non-resonant legs coupleable to said hollow microphone support rod and configured to rest upon said vibration-absorbing receptacles.

13. The microphone support system as recited in claim 1 wherein said base assembly comprises:

a vibration-resistant sub-base having an upper surface and an undersurface;

vibration-isolating feet coupled to said undersurface of said vibration-resistant sub-base;

carbon fiber pits coupled to said upper surface of said vibration-resistant sub-base;

a non-resonant base having a bottom surface;

carbon fiber pucks coupled to said bottom surface of said non-resonant base; and carbon fiber cones having bases and tips, said bases coupled to said pucks and said tips configured to rest upon said pits.

14. The microphone support system as recited in claim 1 further comprising a base assembly cover coupleable to said base assembly.

15. The microphone support system as recited in claim 1 wherein said microphone sheath comprises foam rubber or a polymer resin.

16. The microphone support system as recited in claim 1 wherein said microphone cable sheath comprises a polystyrene foam.

17. The microphone support system as recited in claim 1 further comprising a base assembly cover configured to substantially shield said base assembly from at least some of said extraneous vibrations.

18. The microphone support system as recited in claim 1 wherein said hollow microphone support rod comprises a first section and a second section and further comprising a vibration-conducting coupling configured to couple said first section to said second section.

19. The microphone support system as recited in claim 18 wherein said vibration-conducting coupling comprises a brass collet and a brass jamb nut.

20. A method of manufacturing a microphone support system that substantially isolates a microphone from extraneous vibrations, comprising:

providing a base assembly configured to dampen at least some of said extraneous vibrations communicated to said support system, said base assembly, including:

a vibration-resistant sub-base having an upper surface and an undersurface, vibration-isolating feet coupled to said undersurface, and vibration-absorbing receptacles coupled to said upper surface;

coupling a microphone support rod to said base assembly and configuring said microphone support rod to support a microphone;

coupling a microphone sheath to said microphone support rod and substantially surrounding said microphone, said microphone sheath configured to substantially isolate said microphone from at least some of said extraneous vibrations;

coupling a microphone cable to said microphone; and coupling a microphone cable sheath to and substantially surrounding said microphone cable, said microphone cable sheath configured to substantially isolate said microphone cable from at least some of said extraneous vibrations.

21. The method as recited in claim 20 further comprising coupling an adjustable support pole to said microphone support rod, said adjustable support pole configured to support said microphone.

22. The method as recited in claim 20 wherein coupling a microphone support rod includes coupling a microphone support rod having a vibration-damping coating.

23. The method as recited in claim 22 wherein coupling a microphone support rod having a vibration-damping coating includes coupling a microphone support rod having a vibration-damping coating comprising a rubber coating or polystyrene foam coating.

24. The method as recited in claim 20 wherein coupling a microphone support rod includes coupling a hollow microphone support rod filled with a vibration-damping filling or a solid microphone support rod having vibration-damping properties.

25. The method as recited in claim 24 wherein coupling a hollow microphone support rod filled with a vibration-damping filling includes coupling a hollow microphone support rod filled with a vibration-damping filling comprising sand and lead shot.

26. The method as recited in claim 20 wherein providing a base assembly includes providing a free-standing base assembly or a ceiling-suspended base assembly.

27. The method as recited in claim 20 wherein providing a base assembly includes providing a base assembly cover configured to substantially shield said base assembly from at least some of said extraneous vibrations.

28. The method as recited in claim 20 wherein said vibration-resistant sub-base comprises substantially non-resonant material coated with fiberglass-reinforced epoxy resin.

29. The method as recited in claim 20 wherein said vibration-isolating feet comprise rubber bushings.

30. The method as recited in claim 20 wherein said vibration-absorbing receptacles comprise carbon fiber pits.

31. The method as recited in claim 20 wherein said base assembly further comprises a non-resonant base coupleable to said microphone support rod.

32. The method as recited in claim 20 wherein said base assembly further comprises a plurality of non-resonant legs coupleable to said microphone support rod and configured to rest upon said vibration-absorbing receptacles.

33. The method as recited in claim 20 wherein said vibration-absorbing receptacles comprise carbon fiber pits and said base assembly, further includes:

a non-resonant base having a bottom surface, carbon fiber cones having bases and tips, carbon fiber pucks coupled to said bottom surface of said non-resonant base, and said bases of said cones being coupled to said pucks and said tips of said cones resting upon said pits.

34. The method as recited in claim 20 wherein said base assembly further comprises a base assembly cover coupleable to said base assembly.

35. The method as recited in claim 20 wherein coupling a microphone sheath includes coupling a microphone sheath comprising foam rubber or a polymer resin.

36. The method as recited in claim 20 wherein coupling a microphone cable sheath includes coupling a microphone cable sheath comprising polystyrene foam.

37. The method as recited in claim 20 wherein said microphone support rod comprises a first section and a second section; said coupling a microphone support rod to said base assembly includes employing a vibration-conducting coupling to couple said first section to said second section.

38. The method as recited in claim 37 wherein said vibration-conducting coupling comprises a brass collet and a brass jamb nut.

39. A microphone support system that substantially isolates a microphone from extraneous vibrations, comprising:

a base assembly configured to dampen at least some of said extraneous vibrations communicated to said support system;

a solid microphone support rod, having vibration-damping properties, coupleable to said base assembly and configured to support said microphone;

a microphone sheath substantially surrounding said microphone and coupled to said solid microphone support rod, said microphone sheath configured to substantially isolate said microphone from at least some of said extraneous vibrations;

a microphone cable coupleable to said microphone; and a microphone cable sheath substantially surrounding said microphone cable and configured to substantially isolate said microphone cable from at least some of said extraneous vibrations.

40. The microphone support system as recited in claim 39 wherein said solid microphone support rod comprises a first section and a second section and further comprising a vibration-conducting coupling configured to couple said first section to said second section.

41. The microphone support system as recited in claim 39 further comprising an adjustable support pole coupleable to said solid microphone support rod and configured to support said microphone.

42. The microphone support system as recited in claim 39 wherein said solid microphone support rod comprises a vibration-damping coating.

43. The microphone support system as recited in claim 42 wherein said vibration-damping coating comprises a rubber coating or polystyrene foam coating.

44. The microphone support system as recited in claim 39 wherein said base assembly is a free-standing base assembly or a ceiling-suspended base assembly.

45. The microphone support system as recited in claim 39 wherein said base assembly comprises:

a vibration-resistant sub-base having an upper surface and an undersurface;

vibration-isolating feet coupled to said undersurface; and vibration-absorbing receptacles coupled to said upper surface.

46. The microphone support system as recited in claim 45 wherein said vibration-resistant sub-base comprises a substantially non-resonant material coated with fiberglass-reinforced epoxy resin.

47. The microphone support system as recited in claim 45 wherein said vibration-isolating feet comprise rubber bushings.

48. The microphone support system as recited in claim 45 wherein said vibration-absorbing receptacles comprise carbon fiber pits.

49. The microphone support system as recited in claim 45 wherein said base assembly further comprises a non-resonant base coupleable to said solid microphone support rod.

50. The microphone support system as recited in claim 45 wherein said base assembly further comprises a plurality of non-resonant legs coupleable to said solid microphone support rod and configured to rest upon said vibration-absorbing receptacles.

51. The microphone support system as recited in claim 39 wherein said base assembly comprises:

a vibration-resistant sub-base having an upper surface and an undersurface;

vibration-isolating feet coupled to said undersurface of said vibration-resistant sub-base;

carbon fiber pits coupled to said upper surface of said vibration-resistant sub-base;

a non-resonant base having a bottom surface;

carbon fiber pucks coupled to said bottom surface of said non-resonant base; and carbon fiber cones having bases and tips, said bases coupled to said pucks and said tips configured to rest upon said pits.

52. The microphone support system as recited in claim 39 further comprising a base assembly cover coupleable to said base assembly.

53. The microphone support system as recited in claim 39 wherein said microphone sheath comprises foam rubber or a polymer resin.

54. The microphone support system as recited in claim 39 wherein said microphone cable sheath comprises a polystyrene foam.

55. The microphone support system as recited in claim 39 further comprising a base assembly cover configured to substantially shield said base assembly from at least some of said extraneous vibrations.

* * * * *